United States Patent [19]

De Mol et al.

[11] Patent Number: 4,700,557

[45] Date of Patent: Oct. 20, 1987

[54] SYSTEM AND PROCESS FOR CONTROLLING THE SHAPE OF A STRIP OF METAL

[75] Inventors: Dirk De Mol, San Jose, Calif.; Graham Shaw, Carrigaline, Ireland

[73] Assignee: Measurex Corporation, Cupertino, Calif.

[21] Appl. No.: 931,900

[22] Filed: Nov. 19, 1986

Related U.S. Application Data

[63] Continuation of Ser. No. 671,270, Nov. 14, 1984, abandoned.

[51] Int. Cl.[4] ..... B21B 37/00; B21B 27/10

[52] U.S. Cl. ..... 72/12; 72/17; 72/201

[58] Field of Search ..... 82/8, 9, 12, 17, 45, 82/200, 201, 236

[56] References Cited

U.S. PATENT DOCUMENTS

| | | | |
|---|---|---|---|
| 3,208,253 | 9/1965 | Roberts | 72/201 X |
| 3,613,418 | 10/1971 | Nara et al. | 72/201 X |
| 3,802,237 | 4/1974 | Albensi et al. | 72/201 X |
| 4,247,047 | 1/1981 | Schaming | 72/201 X |
| 4,262,511 | 4/1981 | Boisvert et al. | 72/201 X |
| 4,392,367 | 7/1983 | Bald | 72/201 X |
| 4,467,629 | 8/1984 | Schmion | 72/201 X |
| 4,510,784 | 4/1985 | Hsu | 72/201 |

*Primary Examiner*—E. Michael Combs

*Attorney, Agent, or Firm*—Hal J. Bohner

[57] ABSTRACT

A process is disclosed for controlling the shape of a metal strip being rolled between two rolls. The process includes measuring the shape of the strip, spraying cooling fluid on the rolls, and controlling the spraying of cooling fluid according to a duty cycle.

7 Claims, 2 Drawing Figures

SYSTEM AND PROCESS FOR CONTROLLING THE SHAPE OF A STRIP OF METAL

This application is a continuation of Ser. No. 671,270 filed Nov. 14, 1984, now abandoned.

BACKGROUND OF THE INVENTION

1. Field of the Invention

The invention relates to a system for controlling the shape of a strip metal which is being manufactured.

2. Prior Art

The shape of a strip of metal is defined in the art as the cross-directional stress profiled of the sheet while the sheet is under tension. During production of a strip of metal, and particularly during the rolling process, the shape of the strip can be changed. It is important that after production the shape of the strip is as nearly perfectly flat as possible, i.e. minimal cross-directional variations in stress. Various methods are known for accomplishing this.

U.S. Pat. No. 4,262,511 teaches a system for controlling the shape of sheet metal. According to the patent a metal sheet is compressed between a pair of driven shaping rolls, or work rolls. The sheet is measured by a shapemeter, and deviations from a predetermined target shape are corrected. One of the methods of correction is to spray cooling liquid onto the work rolls in the area in which the rolls are determined to be applying excessive force to the sheet. Thus the rolls are cooled so that they contract and consequently apply less force.

According to the patent, an incremental increase or decrease in coolant spray is applied as long as the shape, as measured by the shapemeter, is outside specified limits. Then, when the shape is within limits, the sprays are returned to their normal level.

It has been found that controlling the sprays in the manner taught in the patent can lead to the production of sheet in which the shape is not well controlled and cannot effectively control foil producing rolling mills. Sheet is defined as strip which is greater in thickness than 0.006 inch, and foil is a strip of less than 0.006 inch thickness.

OBJECTS OF THE INVENTION

An object of the present invention is to provide accurate shape control.

Another object is to control a foil producing rolling mill.

Further objects and advantages of the present invention can be ascertained by reference to the specification and drawings which are offered by way of example and not in limitation of the invention which is defined by the claims and equivalents.

DESCRIPTION OF THE PREFERRED EMBODIMENT

Figure 1:
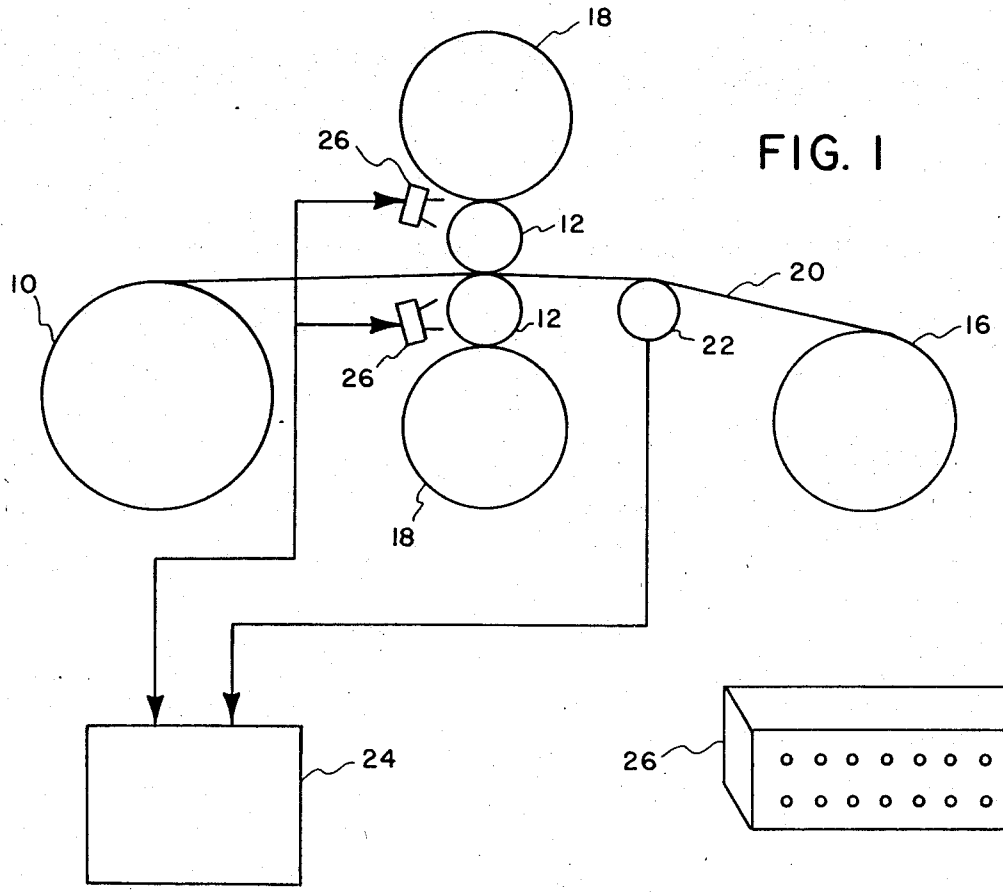
FIG. 1 is a schematic illustration of the present embodiment.

FIG. 1 schematically illustrates a rolling mill utilizing the present embodiment. A roll 10 of metal is horizontally disposed adjacent a pair of cylindrical work rolls 12, and a re-wind 16 is located to the right of the rolls 12. A cylindrical back-up roll 18 is located above the upper work roll 12, and a second back up roll 18 is located below the lower work roll 12. The re-wind roll 16 is coupled to a drive means, not shown, to drive the roll in a clockwise direction to wrap the metal into a coil. The work rolls 12 are on bearings, are driven to rotate by drive means, not shown, and are spaced apart a predetermined, controllable distance.

The back-up rolls 18 are mounted on bearings so they are free to rotate, and the back-up rolls 18 are also mounted so that they can controllably apply pressure to force the work rolls 12 toward one another. Normally means are provided to control the pressure so applied; however such control means do not form part of the present invention and therefore will not be discussed herein.

A shapemeter 22 is mounted to contact the strip 20 after the strip leaves the work rolls 12. The shapemeter 22 is generally cylindrical and is capable of measuring the shape of the sheet 20 in a plurality of zones across the sheet. The shapemeter 22 includes a plurality of transducers to convert the measured shape in each zone to electrical signals and transmit the signals to a control unit 24. The control unit 24 includes a computer to receive the signals and perform computations thereupon.

Figure 2:
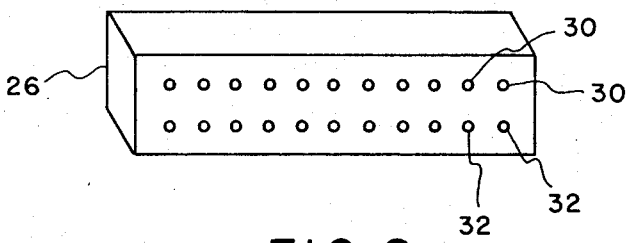
FIG. 2 is a detail of part of the system shown in FIG. 1.

Two spray bars 26 are located adjacent the two work rolls 12. Each shape bar 26 extends the length of the adjacent work roll 12 and includes a plurality of spray nozzles, as illustrated in FIG. 2. The nozzles are located in two horizontal rows adjacent one another, and one row comprises nozzles each of which is capable of delivering 50% of the flow of fluid with respect to each nozzle of the second row. The nozzles are grouped in pairs, comprising one small nozzle 30 and one large nozzle 32. The nozzles of each pair are directed to spray fluid on the same zone of a work roll 12. It should be understood that other configurations of the spray nozzles can be used. For example, in some cases there may be three horizontal rows of nozzles.

The spray bars 26 include valves, not shown, coupled one to each nozzle 30 and 32 and controllable by signals from the control unit 24. Generally spray bars are constructed by the manufacturer so that the spray from a nozzle is either fully on or fully off but not variable between the full on and off positions. Thus in controlling the sprays one has the option of providing either no flow, 33% of total flow, 66% of total flow or 100% of total flow, by opening none, the small nozzle 30, the large nozzle 32 or both nozzles.

The control process according to the present embodiment is accomplished in the following way. For each zone across the width of the strip the shape is measured by the shapemeter 22. When it is desired to increase or decrease the spacing between the rolls 12 in a particular zone the corresponding spray nozzles are opened or closed as necessary. The sprays are operated in cycles with each cycle being initiated a predetermined time after the initiation of the immediately preceding cycle. During each cycle a spray is on for a controllable period of time and off for the remainder of the cycle. This is called duty cycling. For example, if the cycle time is about ten seconds, which is a cycle time we have found preferable in many circumstances, and it is desired to apply 10% cooling to a zone, then the small nozzle 30 is opened 3.3 seconds (i.e. one-third of the duty cycle) and thereafter closed 6.7 seconds and then opened 3.3 seconds and so forth. As another example, if it is desired to apply cooling spray at the rate of 66% of total flow, small nozzle 30 is open continuously and the large nozzle 32 is on for five seconds followed by off for five seconds and so forth.

We have found some special advantages in controlling the sprays according to duty cycles. By means of duty cycling, it is possible to provide any desired quantity of sprayed fluid over a continuous range. That is, one is not restricted to providing e.g. only 33% or 66% of total flow.

Another advantage can be understood as follows. Based upon testing it has been determined that the time constant for heating and cooling work rolls can be on the order of 20–30 seconds in some circumstances. In other words tests have shown that for some rolls, if cooling sprays are applied it will take considerable time for the rolls to change diameter since they are quite massive and thus have considerable heat capacity. Of course, after application of the spray the roll will eventually contract to some minimum diameter and thereafter contract no further. In some cases the time constant has been found to be 20–30 seconds which means that in that time the roll exhibits about 63% of the total contraction it would after a very long time.

Thus since the time constant is 20–30 seconds, our use of a duty cycle time of about 10 seconds insures that the roll responds only slightly, to turning the sprays on and off, and the diameter remains very near the target diameter with only slight, if any, variations through time.

We have found a particular schedule of duty cycling to be advantageous. When the large sprays provide 66% of total flow and the small sprays 33% we duty cycle as follows. If it is desired to provide flow in the range of 0–33%, the large nozzle 32 is continuously off and the small nozzle 30 is duty cycled. When flow in the range of 33–66% is required, the small nozzle 30 is never on, and the large nozzle 32 is duty cycled. When flow of 66–100% is required, the small nozzle 30 is continuously on, and the large nozzle 32 is duty cycled.

This procedure is advantageous over an alternative scheme of duty cycling valve 32 with valve 30 off when the range is 33–66%. We have found that although sprays may nominally be rated 33 and 66% they often do not deliver exactly such percentages. Consequently if the system were delivering e.g. 65% without any use of nozzle 30 and the required delivery rose to e.g. 67%, the controller would assume that nozzle 30 should be on continuously and turn it on. However, if nozzle 30 delivered far more or less than the expected percentage, when it would be continuously turned on, the control process could become upset, and it would take some time for the process to begin correctly cycling nozzle 32 to make up for the deviation between actual and expected flow. In other words, we have found it preferable that the operating program for each nozzle be designed so that when the range of total required delivery changes, the nozzle is changed from being duty cycled to continuously off or on, but that the nozzle never changes from continuously off to continuously on or vice versa.

We claim:

1. A process for controlling the shape of a metal strip being rolled between two rolls, the process comprising:

(a) measuring the shape of the strip;

(b) spraying cooling fluid on at least one of the rolls in a plurality of zones;

(c) controlling the spraying of cooling fluid based on the measured shape in order to control the shape of the metal strip, wherein the cooling fluid is sprayed in cycles of predetermined time, with each cycle being initiated a predetermined time after the initiation of the immediately preceding cycle.

2. A process according to claim 1 wherein the strip is foil.

3. A process according to claim 1 wherein the predetermined time between successive cycles is about ten seconds.

4. A process according to claim 1 wherein cooling fluid is sprayed from a plurality of pairs of nozzles, each pair being located to direct a spray of fluid at a predetermined zone on one of the rolls.

5. A process according to claim 1 wherein the shape of the strip is measured in each of said zones across the strip and cooling fluid is controllably sprayed in each of said zones based on the measured shape in each zone.

6. A process according to claim 1 wherein during each cycle a spray is on for a controllable period of time and off for the remainder of the cycle.

7. A system for controlling the shape of a metal strip being rolled between two rolls, the system comprising:

(a) measurement means for measuring the shape of the strip;

(b) nozzle means for spraying cooling fluid on at least one of the rolls in a plurality of zones;

(c) a control system coupled to the measurement means and to the nozzle means for controlling the spraying of cooling fluid based on the measured shape in order to control the shape of the metal strip, wherein the cooling fluid is sprayed in cycles of predetermined time, with each cycle being initiated a predetermined time after the initiation of the immediately preceding cycle.

* * * * *